US007101446B2

(12) United States Patent
Takeda et al.

(10) Patent No.: US 7,101,446 B2
(45) Date of Patent: Sep. 5, 2006

(54) AUSTENITIC STAINLESS STEEL

(75) Inventors: Kiyoko Takeda, Nishinomiya (JP); Haruhiko Kajimura, Hikari (JP); Mitsuo Miyahara, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/143,610

(22) Filed: Jun. 3, 2005

(65) Prior Publication Data

US 2005/0232805 A1 Oct. 20, 2005

Related U.S. Application Data

(63) Continuation-in-part of application No. PCT/JP03/15907, filed on Dec. 11, 2003.

(30) Foreign Application Priority Data

Dec. 12, 2002 (JP) ..... 2002-360728

(51) Int. Cl.
*C22C 38/00* (2006.01)

(52) U.S. Cl. ..... 148/327; 420/43; 420/49; 420/50

(58) Field of Classification Search ..... 420/43, 420/49, 50; 148/327
See application file for complete search history.

(56) References Cited

FOREIGN PATENT DOCUMENTS

| | | | |
|---|---|---|---|
| JP | 08-283915 | | 10/1996 |
| JP | 11-350085 | | 12/1999 |
| JP | 2001-164341 | | 6/2001 |
| JP | 2001-323341 | | 11/2001 |
| JP | 2002194506 | * | 7/2002 |
| KR | 2001002733 | * | 1/2001 |
| KR | 2002047579 | * | 6/2002 |

OTHER PUBLICATIONS

H. Aoyama, "Contraction of Cold Rolled Austenitic Stainless Steels during Annealing at Low Temperature", CAMP-ISIJ vol. 15 (2000)-559.
H. Aoyama, "Contraction of Cold Rolled Austenitic Stainless Steels during Annealing at Low Temperature", Tetsu To Hagane, vol. 81 (1995), No. 5, pp. 65-70.
H. Aoyama, "Effect of Applied Stress on Flatness of Cold Rolled Austenitic Stainless Steels during Low Temperature Annealing", Tetsu To Hagane, vol. 81 (1995), No. 9, pp. 32-37.
H. Aoyama, "Contraction of Cold Rolled Austenitic Stainless Steels Induced by Leveling", Tetsu To Hagane, vol. 92 (1996), No. 10, pp. 37-42.

* cited by examiner

*Primary Examiner*—Sikyin Ip
(74) *Attorney, Agent, or Firm*—Clark & Brody

(57) ABSTRACT

An austenitic stainless steel with minimized deformation by heating and cooling treatment after cold working, which consists of, % by mass, C: 0.03% or less, Si: 2 to 4%, Mn: 0.1 to 2%, P: 0.03% or less, S: 0.03% or less, Ni: 9 to 15%, Cr: 15 to 20%, N: 0.02 to 0.2%, Nb: 0.03% or less, each of Mo and Cu or a total of Mo and Cu: 0.2 to 4%, and the balance Fe and impurities, and satisfies the following formulas (1) and (2). This steel can also have good weldability when the following formula (3) is also satisfied in addition to the formulas (1) and (2);

$$16.9+6.9Ni+12.5Cu-1.3Cr+3.2Mn+9.3Mo-205C-38.5N-6.5Si-120Nb \geqq 40 \quad (1)$$

$$450-440(C+N)-12.2Si-9.5Mn-13.5Cr-20(Cu+Ni)-18.5Mo \leqq -90 \quad (2)$$

$$8.2+30(C+N)+0.5Mn+Ni-1.1(1.5Si+Cr+Mo)+2.5Nb \leqq -0.8 \quad (3)$$

wherein each element symbol in the formulas (1), (2) and (3) represents the content, % by mass, of each element included in the steel.

2 Claims, 1 Drawing Sheet

AUSTENITIC STAINLESS STEEL

This application is a continuation-in-part of International Patent Application No. PCT/JP2003/015907, filed Dec. 11, 2003. This PCT application was not in English as published under PCT Article 21(2).

TECHNICAL BACKGROUND

The present invention relates to an austenitic stainless steel, more specifically, an austenitic stainless steel with minimized deformation by heating and cooling treatment after cold working. The steel is suitable for structural members of automobiles.

Austenitic stainless steels have been used for various structures because of their excellent workability, strength, corrosion resistance, and the like. In most cases, they are cold worked prior to use.

In the austenitic stainless steels, work-induced martensite may generate during cold working depending on their chemical compositions. In order to prevent this, the following invention is disclosed.

Publication of Japanese Unexamined Patent Application Hei-8-283915 discloses an invention relating to an austenitic stainless steel, which has improved workability due to adjusting the chemical composition, which reduces the generation of work-induced martensite, and also due to controlling the crystal grain size, which reduces work hardening. However, in this invention, the deformation by heating and cooling treatment after cold working is not taken into consideration at all.

It is reported that austenitic stainless steels deform when annealed at a relatively low temperature after cold working. Such a deformation is explained with several different indicators such as stacking fault energy and martensitic transformation quantity.

For example, the shrinkages during low-temperature heat treatment of cold rolled austenitic stainless steels of SUS 301 to SUS 310S are reported in the following literatures 1 to 4. However, in these non-patent literatures, the quantity of shrinkage is explained only with the stacking fault energy of the steel. The deformation and weldability, which is necessary for structure, of high-Si austenitic stainless steels containing Cu, Mo and the like has not been examined at all. Improvement of such high-Si austenitic stainless steels is an objective of the present invention.

Literature 1: CAMP-ISIJ, vol. 15 (2002)-559

Literature 2: TETSU TO HAGANE, Vol. 81 (1995), No.5, pp. 65–70

Literature 3: TETSU TO HAGANE, Vol. 81 (1995), No.9, pp. 32–37

Literature 4: TETSU TO HAGANE, Vol. 82 (1996), No.10, pp. 37–42

Publication of Japanese Unexamined Patent Application 2001-323341 discloses a stainless steel plate having high strength and improved flatness, in which shape correction is performed by use of the work-induced martensite during cold working and by use of shrinkage due to the reverse transformation from martensitic phase to austenitic phase in low-temperature annealing. However, this literature describes neither the inhibition of deformation by heating and cooling treatment after cold working nor the weldability necessary for structure.

DISCLOSURE OF INVENTION

It is the primary objective of the present invention to provide a high-Si austenitic stainless steel with minimized deformation by heating and cooling treatment after cold working.

It is the second objective of the present invention to provide a high-Si austenitic stainless steel having not only minimized deformation by heating and cooling treatment after cold working but also improved weldability.

The austenitic stainless steel of the present invention is particularly suitable for automobile structural members.

The present invention relates to austenitic stainless steels 1 and 2 described below.

1. An austenitic stainless steel consisting of, by mass %, C: 0.03% or less, Si: 2 to 4%, Mn: 0.1 to 2%, P: 0.03% or less, S: 0.03% or less, Ni: 9 to 15%, Cr: 15 to 20%, N: 0.02 to 0.2%, Nb: 0.03% or less, either Mo or Cu, or a total of Mo and Cu: 0.2 to 4%, and the balance Fe and impurities, and satisfying the following formulas (1) and (2);

$$16.9+6.9Ni+12.5Cu-1.3Cr+3.2Mn+9.3Mo-205C-38.5N-6.5Si-120Nb \geqq 40 \quad (1)$$

$$450-440(C+N)-12.2Si-9.5Mn-13.5Cr-20(Cu+Ni)-18.5Mo \leqq -90 \quad (2)$$

wherein each element symbol in the formulas (1) and (2) represents the content, % by mass of each element included in the steel.

2. An austenitic stainless steel consisting of, % by mass, C: 0.03% or less, Si: 2 to 4%, Mn: 0.1 to 2%, P: 0.03% or less, S: 0.03% or less, Ni: 9 to 15%, Cr: 15 to 20%, N: 0.02 to 0.2%, Nb: 0.03% or less, either Mo or Cu, or a total of Mo and Cu: 0.2 to 4%, and the balance Fe and impurities, and satisfying the following formulas (1), (2) and (3);

$$16.9+6.9Ni+12.5Cu-1.3Cr+3.2Mn+9.3Mo-205C-38.5N-6.5Si-120Nb \geqq 40 \quad (1)$$

$$450-440(C+N)-12.2Si-9.5Mn-13.5Cr-20(Cu+Ni)-18.5Mo \leqq -90 \quad (2)$$

$$8.2+30(C+N)+0.5Mn+Ni-1.1(1.5Si+Cr+Mo)+2.5Nb \leqq -0.8 \quad (3)$$

wherein each element symbol in the expressions (1), (2) and (3) represents the content, % by mass of each element included in the steel.

The present invention has been completed based on the knowledge described below.

It can be considered that the deformation by heating and cooling treatment after cold working includes the following deformations (A) and (B).

(A) Shrinkage by reverse transformation of α'-martensite, which is induced by working, to austenite.

(B) Shrinkage by reverse transformation of ε-martensite, which is generated as an intermediate phase in the generation of α'-martensite.

The higher the value of Md30, the more easily the transformation of α' martensite in (A). The shrinkage of (B) is explained using the stacking fault energy (SFE) as an indicator. The Md30 means a temperature (° C.) at which 50 volume % of martensitic transformation occurs when a tensile true strain of 0.3% is applied.

However, it is difficult to explain and reduce the deformation by heating and cooling treatment after cold working only with the Md30 or SFE, regarding to all the currently available austenitic stainless steels.

Therefore, the present inventors made various experiments in order to solve the above problem, examining the results in detail, and consequently came to know the following.

(a) The deformation by heating and cooling treatment after cold working is a shrinkage caused by interaction between the reverse transformation of work-induced α'-martensite to austenite and the reverse transformation of ε-martensite.

(b) Nb is generally added in order to fix C in the steel in order to improve corrosion resistance. However, when a large quantity of Si is coexistent, Nb reduces the stacking fault energy remarkably and promotes the shrinkage.

(c) Cu and Mo not only improve the corrosion resistance of stainless steel but also effectively reduce the shrinkage.

(d) As a result of examinations for the deformation by heating and cooling treatment after cold working by use of steels of various compositions, it was found that the simultaneous satisfaction of the formula (1) for the stacking fault energy, and the formula (2) for the Md30 described below suffices for the high-Si austenitic stainless steel. The formulas (1) and (2) were found based on the fundamental experiments and complementary experiments thereof $$16.9+6.9Ni+12.5Cu-1.3Cr+3.2Mn+9.3Mo-205C-38.5N-6.5Si-120Nb \geqq 40 \quad (1)$$

$$450-440(C+N)-12.2Si-9.5Mn-13.5Cr-20(Cu+Ni)-18.5Mo \leqq -90 \quad (2)$$

As mentioned above, each element symbol in the formulas (1) and (2) represents the content, % by mass, of each element included in the steel.

When the formula (1) is not satisfied, the deformation caused by a thermal shrinkage by the reverse transformation of the work-induced α'-martensite to austenite is serious. When the formula (2) is not satisfied, the deformation caused by thermal shrinkage during the reverse transformation of ε-martensite is serious. It is particularly important for a high-Si steel containing Nb to simultaneously satisfy the formulas (1) and (2).

In order to prevent high-temperature cracking in the welding and provide satisfactory weldability, a composition that facilitates the formation of δ-ferrite in a weld zone is desirable. Namely, a composition with relatively more Cr and less Ni is preferable. However, in a composition that facilitates the generation of δ-ferrite in the weld zone, the deformation by heating and cooling treatment after cold working tends to be serious. Accordingly, in order to satisfy both the weldability and the minimized deformation, it is required to satisfactorily balance the chemical components.

The present inventors searched for a composition capable of minimizing the deformation by heating and cooling treatment after cold working and facilitating the formation of δ-ferrite in the weld zone. As a result, it was found that the weldability and the minimized deformation can be simultaneously obtained when the following formula (3) is satisfied in addition to the above-mentioned formulas (1) and (2). When the formula (3) is not satisfied, even if the formulas (1) and (2) are satisfied, the weldability remarkably deteriorates although the deformation by heating and cooling treatment after cold working is minimized.

$$8.2+30(C+N)+0.5Mn+Ni-1.1(1.5Si+Cr+Mo)+2.5Nb \leqq -0.8 \quad (3)$$

As mentioned above, each element symbol in the formula (3) represents the content, % by mass, of each element included in steel.

BEST MODE FOR CARRYING OUT THE INVENTION

Figure 1:
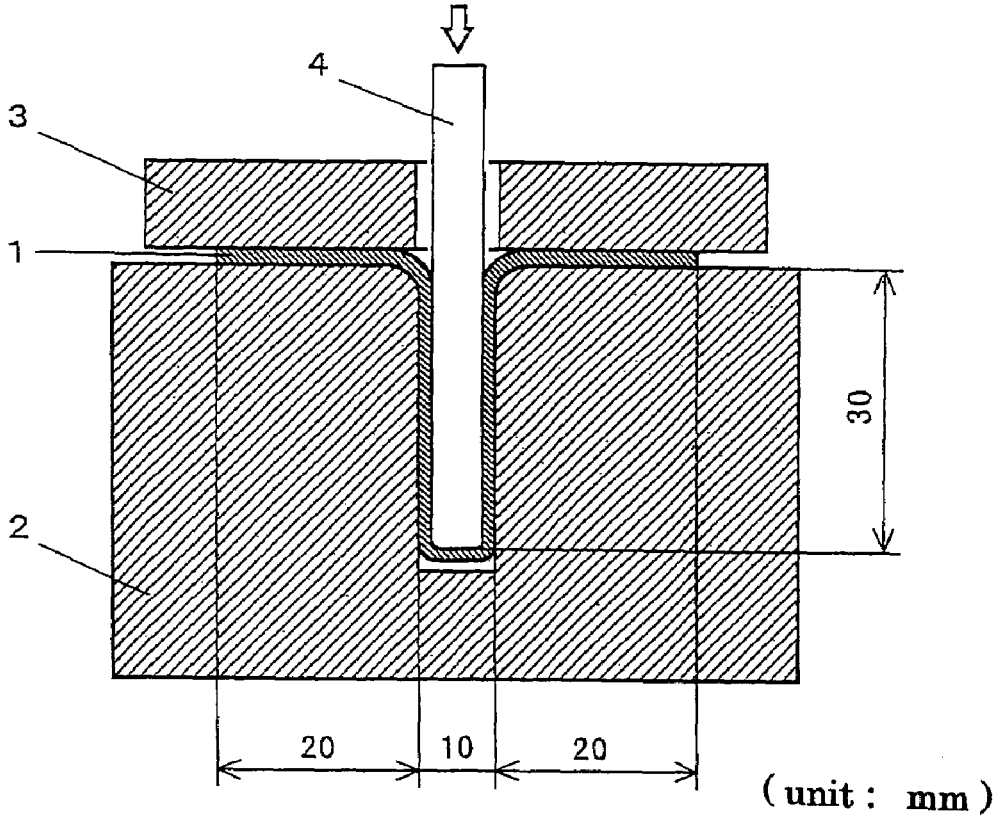
FIG. 1 is a view showing a test method for deformation.

The reason for determining the austenitic stainless steels of the present invention above will now be described in detail. In the following description, "%" represents "% by mass", unless otherwise specified.

C: 0.03% or less

C stabilizes the austenite phase and inhibits work-induced martensitic transformation. On the other hand, it reduces the stacking fault energy. C deteriorates corrosion resistance when precipitates such as Cr carbide in the weld zone. C is fixed within the crystal grains such as Nb carbide when added compositely with Nb. Accordingly, the precipitation such as Cr carbide in the weld zone can be reduced. However, since Nb has an effect of promoting deformation by heating and cooling treatment after cold working, a smaller content of Nb is desirable. Therefore, the content of C should be minimized, and is set to 0.03% or less. The upper limit is preferably 0.025%. The content of Nb will be described later.

Si: 2 to 4%

Si acts as a deoxidizing agent of the steel. It is also effective for improving oxidation resistance of the steel. In order to sufficiently produce these effects, a content of not less than 2% is required. On the other hand, a content exceeding 4% results in deterioration of formability and weldability. Accordingly, the content of Si is set to 2 to 4%. The lower limit is preferably 2.5%, more preferably 3.0%. The upper limit is preferably 3.8%.

Mn: 0.1 to 2%

Mn stabilizes the austenite phase and reduces the deformation by heating and cooling treatment after cold working. Mn is also effective for improving hot workability. To sufficiently produce these effects, a content of not less than 0.1% is required. On the other hand, a content exceeding 2% results in formation of a sulfide (MnS) that is a nonmetallic inclusion in the steel and adversely affects the corrosion resistance and the mechanical properties. Accordingly, the content of Mn is set to 0.1 to 2%. The lower limit is preferably 0.2%, more preferably 0.4%. The upper limit is preferably 1.5%, more preferably 1.0%.

P: 0.03% or less

P is an impurity. Although its content is preferably as low as possible since it deteriorates the corrosion resistance of stainless steel, there is no problem with content of 0.03% or less. Accordingly, the P content is set to 0.03% or less.

S: 0.03% or less

S is an impurity similar to P. S forms a sulfide that is a nonmetallic inclusion, and adversely affects the corrosion resistance and the mechanical properties. It is preferentially concentrated on the surface of weld zone and deteriorates the corrosion resistance of the weld zone. Accordingly, although the S content is preferably as low as possible, there is no problem with the content of 0.03% or less. Accordingly, the S content is set to 0.03% or less. The content is preferably not more than 0.02%, more preferably not more than 0.01%.

Ni: 9 to 15%

Ni stabilizes the austenite phase and reduces the deformation by heating and cooling treatment after cold working. Ni is an important element for maintaining the corrosion resistance of the stainless steel, and a Ni content of not less than 9% is required to ensure sufficient corrosion resistance. An excessive content of Ni makes a generation of δ-ferrite in the weld zone difficult, and easily causes high-temperature cracking during welding. As is found in the above formulas (1), (2) and (3), it is required to determine the upper limit of the Ni content in association with the Cr content. The upper limit of the Ni content is set to 15% in consideration of the facts mentioned above. The lower limit is preferably 10%, more preferably 10.5%, and the upper limit is preferably 13.0%, more preferably 12.5%.

Cr: 15 to 20%

Cr is an inevitable element in order to keep the corrosion resistance of the stainless steel. Cr content less than 15% cannot provide sufficient corrosion resistance. On the other hand, Cr content exceeding 20% causes problems of deterioration in the workability and the price for practical use steel. Accordingly, the Cr-content is set to 15 to 20%. The lower limit is preferably 15.5%, more preferably 16%. The upper limit is preferably 18.0%, more preferably 17.5%.

N: 0.02 to 0.2%

N stabilizes the austenite phase and has an effect of reducing the deformation by heating and cooling treatment after cold working. In addition, it also has an effect of enhancing the strength of the steel. To obtain these effects, An N content of not less than 0.02% is required. On the other hand, since an excessive content of N deteriorates the workability of the steel, the upper limit is set to 0.2%. The lower limit is preferably 0.025%, more preferably 0.03%. The upper limit is preferably 0.15%, more preferably 0.1%.

Each of Mo and Cu, or total of Mo and Cu: 0.2 to 4%

Mo and Cu stabilize the austenite phase and have a big effect of reducing the deformation in heating and cooling after cold working. Mo and Cu also are effective in stabilizing a passive film formed on the surface of stainless steel. In order to obtain these effects, the content of not less than 0.2% of either one or the total of Mo and Cu is required. A content exceeding 4% causes deterioration of hot workability and weldabiity. Accordingly, the contents of each of Mo and Cu or total of these are set to 0.2 to 4%. The lower limit is preferably 0.4%. more preferably 0.7%. The upper limit is preferably 3%. more preferably 2%.

EXAMPLE

Fourteen kinds of austenitic stainless steels, having chemical compositions shown in Table 1, were molten in order to make steel ingots, and the resulting steel ingots were then heated to 1200° C. and formed into objects which are 20 mm in thickness by hot forging. The objects were then heated to 1200° C., and hot rolled, with a working ratio of 5, to make steel plates of 4 mm in thickness.

Each of the resulting steel plates was partially cut and subjected to a solution heat treatment by maintaining at 1100° C. for 15 minutes followed by cooling with water, and resulted in a welding test piece of 4 mm in thickness, 100 mm in width, and 100 mm in length. The test piece surface was then wet-polished with emery paper No.600, and the Transvarestraint test was carried out under the following conditions.

Each of the remaining steel plates was annealed at a temperature of 1100° C. for 15 minutes, and then made into a "cold rolled steel plate of 0.3 mm in thickness" by repeating the procedure of the cold rolling and annealing at 1100° C. for 15 minutes. Then, each steel plate was finished into a "cold rolled and annealed steel plate" by performing the final annealing at 1100° C. for 15 minutes. A test piece of 30 mm in width and 100 mm in length was obtained from each of the resulting cold rolled and annealed steel plates, and its surface was wet-polished with emery paper No. 600 and provided for a deformation test shown in FIG. 1.

The Transvarestraint test was carried out by TIG welding with a welding current of 100A, voltage of 14V and welding rate 15 cm/min in a condition of 3.72% load distortion, and the maximum crack length after welding was measured. Samples with the maximum crack length of less than 0.5 mm were evaluated as good weldability, and samples with not less than 0.5 mm as defective weldability. In Table 1, "○" shows goodweldability, and "x" defective weldability.

Figure 2:
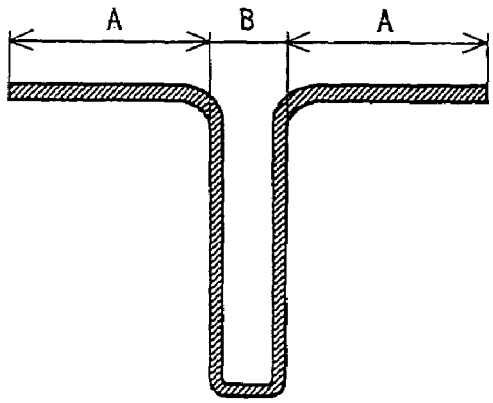
FIG. 2 is a view showing a test piece after plastic deformation in the test.

In the deformation test, as shown in FIG. 1, a test piece 1 was fixed by a lower block 2 and an upper block 3, loaded by pushing a pressing tool 4 to a depth of 30 mm at a room temperature and then unloaded. Thereafter, as shown in FIG. 2, the length of B of the unloaded test piece was measured as the initial length Bx. Then, the unloaded test piece was thermally treated by heating at 600° C. for 30 minutes followed by furnace cooling, and the length of B of the thermally treated test piece was measured as the length By after heating and cooling. The difference between the length Bx and the length By, i.e., "By−Bx" was calculated. Thereafter the ratio of said "By−Bx" value compared to "By−Bx" value of the conventional SUS 304 stainless steel was determined, settling the latter value to 1. Samples with a ratio of not more than 0.4 were evaluated to be excellent with minimized deformation, samples with a ratio of more than 0.4 and not more than 0.6 to be good, and samples with a ratio exceeding 0.6 to be defective with serious deformation. The results are shown in Table 1. In Table 1, "◎", "○" and "x" mean excellent, good and defective respectively.

As is apparent from Table 1, steels Nos. 1 to 7 of the Inventive Examples were minimized in deformation by heating and cooling after cold working. Steels Nos. 1 to 5 were excellent also in weldability.

On the other hand, Steels Nos. 8 to 13 of the Comparative Examples were seriously deformed or were poor in weldability. The result is due to the fact that any one of the components is out of the range regulated by the present invention, or one or more of the formulas (1), (2) and (3) are not satisfied, although the content of each component is within the range regulated by the present invention. Since steel No. 14 was poor in hot workability because of excessive contents of Mo and Cu, it could not be subjected to the evaluation test.

TABLE 1

| Category | No. | Chemical Composition (mass %, Bal.: Fe and impurities) | | | | | | | | | | | |
|---|---|---|---|---|---|---|---|---|---|---|---|---|---|
| | | C | Si | Mn | P | S | Ni | Cr | Mo | Cu | Mo + Cu | Nb | N |
| Steels of the Invention | 1 | 0.015 | 3.50 | 0.80 | 0.010 | 0.001 | 11.50 | 16.50 | 0.20 | 1.50 | 1.70 | 0.005 | 0.04 |
| | 2 | 0.015 | 3.80 | 0.80 | 0.010 | 0.001 | 11.30 | 17.00 | 0.20 | 1.00 | 1.20 | 0.005 | 0.08 |
| | 3 | 0.026 | 3.38 | 0.83 | 0.012 | 0.001 | 11.40 | 16.61 | 0.17 | 0.20 | 0.37 | 0.005 | 0.04 |
| | 4 | 0.017 | 3.39 | 0.85 | 0.013 | 0.001 | 11.52 | 16.49 | 0.16 | 0.99 | 1.15 | 0.005 | 0.033 |
| | 5 | 0.007 | 3.36 | 0.85 | 0.013 | 0.001 | 11.44 | 17.03 | 0.16 | 1.00 | 1.16 | 0.005 | 0.074 |
| | 6 | 0.011 | 3.26 | 0.85 | 0.006 | 0.001 | 14.41 | 16.96 | 0.20 | 0.20 | 0.40 | 0.007 | 0.044 |
| | 7 | 0.016 | 3.29 | 1.70 | 0.006 | 0.001 | 11.92 | 17.09 | 0.20 | 0.21 | 0.41 | 0.005 | 0.105 |
| Comparative Steels | 8 | 0.063* | 0.63* | 0.98 | 0.01 | 0.001 | 8.19* | 18.37 | 0.27 | 0.34 | 0.51 | 0.005 | 0.083 |
| | 9 | 0.023 | 3.46 | 0.87 | 0.011 | 0.001 | 11.07 | 16.41 | 0.05 | 0.05 | 0.10* | 0.120* | 0.040 |
| | 10 | 0.270* | 4.20* | 0.87 | 0.011 | 0.001 | 13.20 | 17.80 | 0.20 | 0.2 | 0.40 | 0.005 | 0.004* |
| | 11 | 0.008 | 3.34 | 0.75 | 0.011 | 0.0007 | 15.40* | 18.40 | 0.20 | 0.1 | 0.30 | 0.130* | 0.008* |
| | 12 | 0.008 | 3.29 | 0.75 | 0.011 | 0.0007 | 11.40 | 15.20 | 0.20 | 0.1 | 0.30 | 0.009 | 0.040 |
| | 13 | 0.008 | 2.45 | 0.87 | 0.011 | 0.0010 | 11.24 | 16.30 | — | 0.05 | 0.05* | 0.130* | 0.050 |
| | 14 | 0.028 | 2.23 | 0.35 | 0.011 | 0.0010 | 11.24 | 16.30 | 2.80 | 2.3 | 5.10* | 0.01 | 0.020 |

| Category | No. | Note 1 | Note 2 | Note 3 | Deformation | Weldability |
|---|---|---|---|---|---|---|
| Steels of the Invention | 1 | 70.01 | −124.31 | −2.38 | ○ | ○ |
| | 2 | 58.24 | −137.62 | −2.43 | ○ | ○ |
| | 3 | 51.26 | −99.50 | −2.03 | ○ | ○ |
| | 4 | 64.14 | −110.08 | −2.25 | ◎ | ○ |
| | 5 | 63.68 | −129.17 | −1.95 | ◎ | ○ |
| | 6 | 75.38 | −162.02 | 0.45** | ○ | X |
| | 7 | 57.55 | −149.03 | 0.17** | ○ | X |
| Comparative Steels | 8 | 39.39* | −54.92* | −0.87 | X | ○ |
| | 9 | 32.68* | −92.82 | −1.92 | X | ○ |
| | 10 | 8.58* | −255.83 | 3.34** | X | X |
| | 11 | 65.49 | −191.87 | −1.19 | X | ○ |
| | 12 | 55.67 | −69.43* | −0.93 | X | X |
| | 13 | 41.59 | −80.18* | −0.03** | X | X |
| | 14 | 106.97 | −158.56 | −3.61 | — | — |

Note 1: Value of the left side of formula (1).
Note 2: Value of the left side of formula (2).
Note 3: Value of the left side of formula (3).
Note 4: Mark "*" indicates that the value is outside of the range according to the invention.
Note 5: Mark "—" in columns "Deformation" and "Weldability" indicates that tests could not be carried out.

INDUSTRIAL APPLICABILITY

The austenitic stainless steel, according to the present invention, is particularly suitable for automotive parts since its deformation by heating and cooling treatment, after cold working, can be minimized.

The invention claimed is:

1. An austenitic stainless steel consisting of, % by mass, C: 0.03% or less, Si: 2 to 4%, Mn: 0.1 to 2%, P: 0.03% or less, S: 0.03% or less, Ni: 9 to 15%, Cr: 15 to 20%, N: 0.02 to 0.2%, Nb: 0.03% or less, each of Mo and Cu or a total of Mo and Cu: 0.2 to 4%, and the balance Fe and impurities, and satisfying the following formulas (1) and (2);

$$16.9+6.9Ni+12.5Cu-1.3Cr+3.2Mn+9.3Mo-205C-38.5N-6.5Si-120Nb \geqq 40 \quad (1)$$

$$450-440(C+N)-12.2Si-9.5Mn-13.5Cr-20(Cu+Ni)-18.5Mo \leqq -90 \quad (2)$$

wherein each element symbol in the formulas (1) and (2) represents the content, % by mass, of each element included in the steel.

2. An austenitic stainless steel including, % by mass, C: 0.03% or less, Si: 2 to 4%, Mn: 0.1 to 2%, P: 0.03% or less, S: 0.03% or less, Ni: 9 to 15%, Cr: 15 to 20%, N: 0.02 to 0.2%, Nb: 0.03% or less, each of Mo and Cu or a total of Mo and Cu: 0.2 to 4%, and the balance Fe and impurities, and satisfying the following formulas (1), (2) and (3);

$$16.9+6.9Ni+12.5Cu-1.3Cr+3.2Mn+9.3Mo-205C-38.5N-6.5Si-120Nb \geqq 40 \quad (1)$$

$$450-440(C+N)-12.2Si-9.5Mn-13.5Cr-20(Cu+Ni)-18.5Mo \leqq -90 \quad (2)$$

$$8.2+30(C+N)+0.5Mn+Ni-1.1(1.5Si+Cr+Mo)+2.5Nb \leqq -0.8 \quad (3)$$

wherein each element symbol in the formulas (1), (2) and (3) represents the content, % by mass, of each element included in the steel.

* * * * *